United States Patent [19]

Probst

[11] Patent Number: 5,037,236

[45] Date of Patent: Aug. 6, 1991

[54] STONE-LAYING MACHINE

[76] Inventor: Martin Probst, Riedstrasse 37, 7141 Steinheim/M., Fed. Rep. of Germany

[21] Appl. No.: 392,030

[22] Filed: Aug. 10, 1989

[30] Foreign Application Priority Data

Aug. 12, 1988 [DE] Fed. Rep. of Germany ..... 3827523

[51] Int. Cl.[5] ..... E01C 19/52

[52] U.S. Cl. ..... 404/99; 404/104

[58] Field of Search ..... 404/98, 99, 104

[56] References Cited

FOREIGN PATENT DOCUMENTS

| | | | |
|---|---|---|---|
| 1207578 | 7/1986 | Canada | 404/99 |
| 2426713 | 12/1975 | Fed. Rep. of Germany | 404/99 |
| 3446231 | 7/1985 | Fed. Rep. of Germany | 404/99 |
| 2593201 | 7/1987 | France | 404/99 |
| 8200194 | 8/1983 | Netherlands | 404/99 |
| 1409713 | 7/1988 | U.S.S.R. | 404/99 |

*Primary Examiner*—Ramon S. Britts
*Assistant Examiner*—Gay Ann Spahn
*Attorney, Agent, or Firm*—Peter E. Rosden

[57] ABSTRACT

A stone-laying machine is provided have laying tongs fixed to a boom arm which can be controlled from the driver's cab. The front and rear wheels of the machine are rotatable about points of rotation lying on a longitudinal center line behind the front axle and in front of the rear axle, respectively. In order to prevent overturning of the machine when the front and rear axles are swivelled in relation to one another, the center of gravity of the machine is altered with respect to conventional stone-laying machines by relocating the boom arm relative to the front axle.

20 Claims, 1 Drawing Sheet

STONE-LAYING MACHINE

Figure 1:
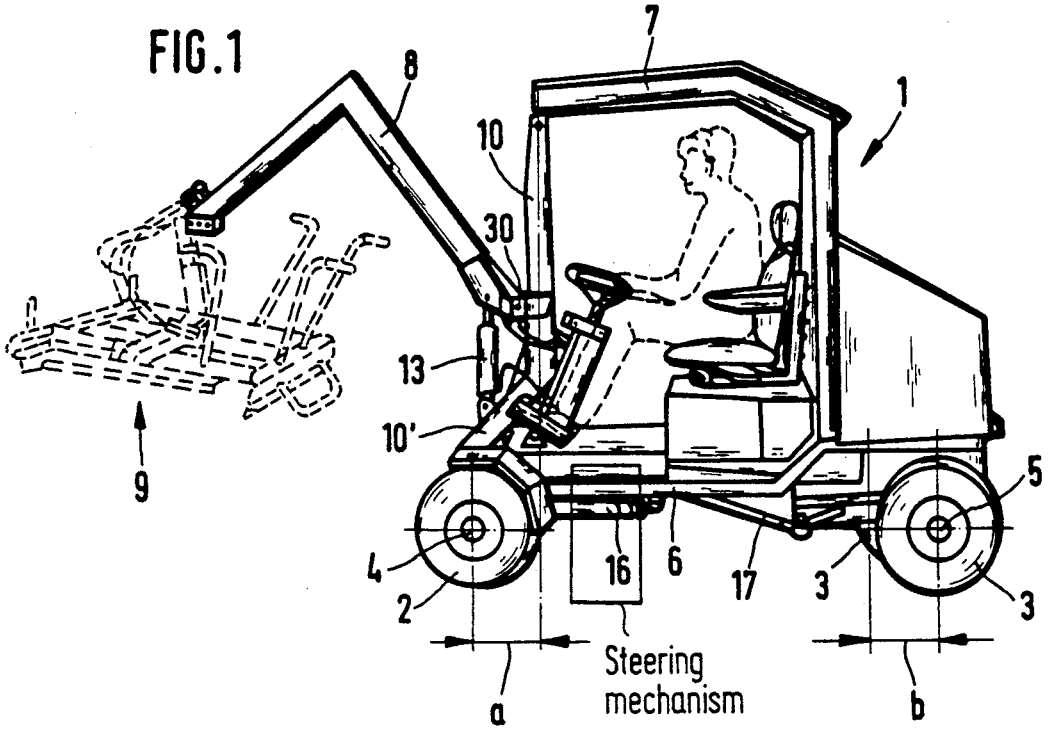

The invention relates to a stone-laying machine according to the pre-characterizing clause of claim 1.

A stone-laying machine is known, of the type in which laying tongs, for example for paving stones or the like, is fixed to a boom arm, which can be controlled from the driver's cab of the laying machine. In this known laying machine, the front wheels are rotatable about a point of rotation, which lies on the longitudinal centre line of the laying machine behind the front axle. In a corresponding manner, the rear wheels are rotatable about a point of rotation, which lies on the said longitudinal centre line in front of the rear axle. At the same time, supporting parts, which hold the front axle or the rear axle respectively, are swivellably articulated on an oblong distance piece in the said points or rotation. The main superstructure, such as for example the combustion engine, the drive hydraulics, the driver's seat and the boom arm are, in this laying machine, fixed to the supporting piece which holds the front axle. A problem of such a laying machine can arise if, during a laying operation in motion, the front and rear axle are swivelled in relation to one another in such a manner that the centre of gravity of the laying machine lies outside the mathematical line which connects the centre points of the longitudinal extent of the front and rear axle to one another. It may then be the case that the entire laying machine overturns. In order to exclude this possibility, the above-mentioned extreme angling of the front axle to the rear axle in the known laying machine must be avoided in motion. As a result of this, however, the radius of action of the laying machine is reduced.

The object of the present invention is, therefore, to improve a stone-laying machine of the type referred to in the introduction in such a manner that its radius of action is increased, without there being any risk of the laying machine overturning.

The object is achieved by means of a stone-laying machine of the type referred to in the introduction, which is characterized by the features indicated in the characterizing part of claim 1.

A major advantage of the present stone-laying machine is that it has a comparatively large radius of action or is very manoeuvrable. Laying work can consequently be made considerably easier. A further achievement is that the stone-laying machine according to the invention is more universally applicable than comparable known laying machines.

A further advantage of the invention is that the centre of gravity of the laying machine lies very deep with sufficient ground clearance as a result of the new design of the chassis, and this leads to a further increase in stability.

Conditional upon this new design, the driver's seat can be arranged in a deep position, which makes it possible to get in and out comfortably. Advantageously, the laying machine according to the invention is particularly easy to control. Advantageously, in the laying machine according to the invention, the front and rear wheels are automatically steered in opposite directions using only one steering cylinder, which leads to the particularly great manoeuvrability and consequently to the good radius of action. In the stone-laying machine according to the invention, it is advantageously at the same time always ensured that the centre of gravity of the laying machine does not deviate so far out of the area of the line connecting the centre points of the longitudinal extent of the axles that a detrimental and dangerous overturning moment can arise.

The manoeuvrability in the present laying machine is great because the boom arm follows the rotation of the front axle.

Advantageously, the stone-laying machine according to the invention is constructed relatively simply and can thus also be manufactured economically.

Figure 2:
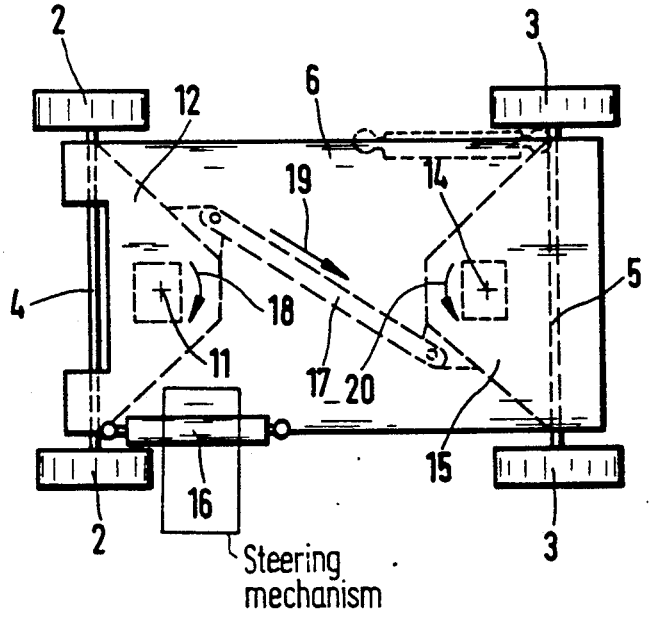

The invention and its developments are described in greater detail below with reference to the figures, in which FIG. 1 shows a side view in perspective of the present stone-laying machine and FIG. 2 shows a view from above of the laying machine in FIG. 1 to clarify the steering device.

The following considerations led to the invention:

In order to achieve increased stability in motion with as small a turning radius as possible, in comparison with the known laying machines, the idea was first formulated of arranging the boom arm in such a manner that it follows the steering movement of the front wheels and of fixing the above-mentioned superstructure and mountings of the laying machine not on the supporting part for the front axle but on the base frame, which connects the supporting parts for the front and rear axle. Since the boom are is to follow the movement of the front axle, the entire load amount would have to be supported solely above the front point of rotation. For this reason, the construction would have to be made particularly strong in this area especially, which leads, however, to the centre of gravity of the laying machine being moved forward in an undesirable manner and to the driver's view of the laying edge being obstructed as a result of the strengthened construction.

To prevent the above-mentioned problems, the boom arm in the present invention is, therefore, not only fixed in the area of the front axle, but to an axle which runs perpendicularly to the front point of rotation, which is rigidly connected to the front axle and which is rotatably supported above the front point of rotation in a further point of rotation, which is preferably located in the roof construction of the laying machine. The result of this is that the entire fixing construction for the boom arm can be executed relatively simply and with low weight, since the forces exerted by the boom arm do not act exclusively on the front axle, but are also distributed over the area of the roof construction of the laying machine.

In FIG. 1, the present stone-laying machine is indicated with 1. Essentially it comprises front wheels 2, rear wheels 3, a front axle 4 which connects the front wheels, a rear axle 5 which connects the rear wheels, a base frame 6, on which the front axle 4 and the rear axle 5 are steerably held by a steering device which is described later and in greater detail, a superstructure, with a roof construction 7, arranged on the base frame 6, and a boom arm 8, which can be operated from the driver's cab of the laying machine 1 and at the free end of which laying tongs 9 known per se or the like can be fixed. The laying machine 1 is equipped with a drive motor, which is not represented in greater detail and which in particular is in the form of an electric motor or a diesel engine.

The boom arm 8, which preferably in the form of an angle open in a downward direction, is with its one free end fixed swivellably in the vertical plane about the point of rotation 30 on an axle 10, which runs perpendicularly to the point of rotation 11, about which the front axle 4 is swivellable on the base frame 6. Preferably, the point of rotation 11 lies behind the front axle 4 on the longitudinal centre line of the laying machine 1, its distance from the front axle being a. To this end, the front axle 4 is preferably held in a supporting part 12, which preferably is in the form of a plate, the one side of the plate being fixed to an area which holds the front axle 4 rotatably and the point of rotation 11 lying in the area of the other side of the plate. The axis 10 which runs perpendicularly to the point of rotation 11 is connected rigidly to the fixing device 12, so that said axle follows the movement of the front axle 4. Preferably, the end facing towards the base frame 6 of the axle 10 has an end area 10', which runs at an angle in the direction of the front axle 4 and which is rigidly connected to the area which holds the front axle 4 rotatably. The opposite end of the axle 10 is rotatably connected above the front point of rotation 11 in a part which is connected to the base frame 6 or the vehicle superstructure. In particular, the said end of the axle 10 is rotatably mounted in an area of the roof construction 7 of the laying machine 1.

The boom arm 8 is preferably operated by means of a lifting cylinder 13, which can be controlled from the vehicle cab, the one end of which being connected to the boom arm 8 and the other end to the laying machine 1, preferably to the end area 10' which extends from the axle 10 to the front axle 4.

In the manner shown in FIG. 2, the rear axle 5 is, similarly to the front axle 4, rotatably mounted on the base frame 6, the rear point of rotation 14 also lying on the longitudinal centre line of the laying machine 1 and in front of the rear axle 3 (sic), and its distance from the rear axle being b. Preferably, the rear axle 5 is fixed by means of a fixing device 15, which is also in the form of a plate, the one side of which being fixed to an area which holds the rear axle 5 rotatably and the point of rotation 14 being arranged in the area of the other side of the plate. Steering is preferably carried out by a steering cylinder 16, which on the one hand is fixed to the base frame 6 and on the other expediently to the fixing device 12 which holds the front axle 4. The steering cylinder 16 is controlled from the driving cab. In order to bring about a coupling between the steering movement of the rear axle 5 and the steering movement of the front axle 4, a coupling rod 17 is preferably provided, the one end of which is pivoted on the front fixing device 12 and the other end of which is pivoted on the rear fixing device 15 in such a manner that the front and rear wheels 4,5 are steered in opposite directions. In particular, the ends of the coupling rod 17 are pivoted on side faces of the fixing device 12, 15, which in relation to the steering centre line of the laying machine 1 lie opposite one another.

Instead of the said coupling rod, two steering cylinders can also be provided, which are controlled in phase opposition and each of which is active between one supporting part 12, 15 and the base frame. The said steering cylinder or cylinders can also be replaced with so-called steering gears.

If, for example, the front axle is steered in such a manner that there is a rotation in the clockwise direction (arrow 18) in the front point of rotation 11, the coupling rod 17 is pushed in the direction of the arrow 19, the result of which is that the rear axle 5 is rotated about the point of rotation 14 in the anti-clockwise direction (arrow 20).

By means of specific variation of the lengths a and b, the steering angle and consequently the turning circle and the stability can be optimized to adapt the laying machine to different applications, without any major reconstruction being necessary as a result of this.

It is of major importance that the base frame 6, which supports the superstructure and the essential mountings of the laying machine 1, is arranged in such a manner that it comprises the points of rotation 11, 14 for the supporting parts 12, 15 for the front and rear axle 4, 5 and that at the same time the boom arm 8 is fixed to an axle 10, which extends perpendicularly to the front point of rotation 11 and of which the one end is rigidly fixed to the front supporting part 12 and the other end is rotatably fixed to the superstructure of the base frame 6, preferably to a roof construction 7. At the same time it is of particular significance that the centre of gravity of the base frame 6 and of the mountings and superstructure arranged on it in the present laying machine can lie only a little above the plane of the front and rear axle 4, 5.

It is also conceivable to form the boom arm 8 in such a manner that it can be raised and lowered along the axle 10, with or without a simultaneous swivelling movement.

I claim:

1. A stone-laying machine used in paving and moving curb and composite stones or similar materials, comprising:

a base frame which supports the essential superstructure and mountings of the stone-laying machine;

a roof construction for the machine attached to said base frame;

a front fixing device movably attached to said base frame;

a front axle held movably to said base frame by said front fixing device;

a front point of rotation about which said front fixing device and said front axle are rotatable on said base frame;

a perpendicular axle connected on one end rigidly and fixedly to said front fixing device wherein the axis of said perpendicular axle runs coaxially with the vertical axis running through said front point of rotation;

a boom arm movable in a vertical plane wherein said boom arm is fixed to said perpendicular axle;

a rear fixing device attached to said base frame;

a rear axle held movably to said base frame by said rear fixing device; and a rear point of rotation about which said rear fixing device and said rear axle are rotatable on said base frame.

2. The machine of claim 1, further including coupling means for coupling said front and rear fixing devices to one another in such a manner that when said front axle is rotated in one direction, said rear axle is caused to rotate in the opposite direction.

3. The machine of claim 2, wherein said coupling means is a coupling rod having one side thereof rotatable connected on one side of the longitudinal center line of the machine at said front fixing device and having the other end thereof rotatably connected on the other side of the longitudinal center line of the machine at said rear fixing device.

4. The machine of claim 3, further including steering means operable from the driver's cab of the machine for steering the machine.

5. The machine of claim 4, wherein said steering means is situated between said base frame and said front fixing device.

6. The machine of claim 5, wherein said steering means is a steering cylinder.

7. The machine of claim 5, wherein said steering means is a steering gear.

8. The machine of claim 4, wherein said steering means is situated between said base frame and said rear fixing device.

9. The machine of claim 4, wherein said steering means comprises a first rotatable steering cylinder situated between said base frame and said front fixing device and a second rotatable steering cylinder situated between said base frame and said rear fixing device wherein said first and said second rotatable steering cylinders rotate simultaneously in opposite directions from one another.

10. The machine of claim 4, wherein said steering means comprises a first rotatable steering gear situated between said base frame and said front fixing device and a second rotatable steering gear situated between said base frame and said rear fixing device wherein said first and said second rotatable steering gears cause rotation simultaneously in opposite directions from one another.

11. The machine of claim 6, wherein said front point of rotation lies on the longitudinal center line of the machine behind said front axle.

12. The machine of claim 9, wherein said front point of rotation lies on the longitudinal center line of the machine behind said front axle.

13. The machine of claim 12, wherein said rear point of rotation lies on the longitudinal center line of the machine in front of said rear axle.

14. The machine of claim 11, wherein the other end of said perpendicular axle is rotatably mounted to said roof construction.

15. The machine of claim 14, wherein one end of said perpendicular axle includes an end section which runs at an angle from a place on said perpendicular axle above said base frame in the direction of said front axle and is attached to an area surrounding said front axle.

16. The machine of claim 15, further including a lifting cylinder situated between said end section and said boom arm, wherein said lifting cylinder is operable from the driver's cab of the machine for swiveling and lifting said boom arm in the vertical plane.

17. The machine of claim 16, wherein the center of gravity of said base frame and of the mountings and superstructure arranged thereon lies slightly above the plane of said front axle and said rear axle.

18. A stone-laying machine used in paving and moving curb and composite stones or similar materials, comprising:

a base frame which supports the essential superstructure and mountings of the stone-laying machine;

a roof construction for the machine attached to said base frame;

a front fixing device movably attached to said base frame;

a front axle held movable to said base frame by said front fixing device wherein the plane of said front axle lies slightly below the center of gravity of said base frame;

a front point of rotation about which said front fixing device and said front axle are rotatable on said base frame wherein said front point of rotation lies on the longitudinal center line of the machine behind said front axle;

a perpendicular axle connected on one end rigidly and fixedly to said front fixing device wherein the axis of said perpendicular axle runs coaxially with the vertical axis running through said front point of rotation and therein movement of said perpendicular axle necessarily duplicates rotational movement of said front fixing device about said front point of rotation;

a boom arm movable in a vertical plane wherein said boom arm is fixed to said perpendicular axle;

a rear fixing device attached to said base frame;

a rear axle held movable to said base frame by said rear fixing device wherein the plane of said rear axle lies slightly below the center of gravity of said base frame;

a rear point of rotation about which said rear fixing device and said rear axle are rotatable on said base frame wherein said rear point of rotation lies on the longitudinal center line of the machine in front of said rear axle;

a coupling means for coupling said front and said rear fixing devices to one another in such a manner that when said front axle is rotated in one direction, said rear axle is caused to rotate in the opposite direction; and steering means operable from the driver's cab of the machine for steering the machine.

19. A stone-laying machine used in paving and moving curb and composite stones or similar materials comprising:

a base frame which supports the essential superstructure and mountings of the stone-laying machine;

a roof construction for the machine attached to said base frame;

a front fixing device movably attached to said base frame;

a front axle held movably to said base frame by said front fixing device wherein the plane of said front axle lies slightly below the center of gravity of said base frame;

a front point of rotation about which said front fixing device and said front axle are rotatable on said base frame wherein said front point of rotation lies on the longitudinal center line of the machine behind said front axle;

a perpendicular axle having an axis which is coaxial with the vertical axis running through said front point of rotation having on one end an end section which runs at an angle from a place on said perpendicular axle above said base frame in the direction of said front axle and is attached to an area surrounding said front axle and being on the other end of said perpendicular axle rotatably attached to said roof construction, wherein movement of said perpendicular axle necessarily duplicates rotational movement of said front fixing device about said front point of rotation;

a boom arm movable in a vertical plane wherein said boom arm is fixed to said perpendicular axle and;

a rear fixing device attached to said base frame wherein said rear fixing device attached to said base frame wherein said rear fixing device is coupled to said front fixing device in a manner such that when said front axle is rotated in one direction, said rear axle is caused to rotate in the opposite direction;

a rear axle held movably to said base frame by said rear fixing device wherein the plane of said rear axle lies slightly below the center of gravity of said base frame;

a rear point of rotation about which said rear fixing device and said rear axle are rotatable on said base frame wherein said rear point of rotation lies on the longitudinal center line of the machine in front of said rear axle;

a coupling rod for coupling said front and said rear fixing devices to one another wherein one side of said coupling rod is rotatably connected on one side of the longitudinal center line of the machine at said front fixing device and the other end of said coupling rod is rotatably connected on the other side of the longitudinal center line of the machine at said rear fixing device;

steering means operable from the driver's cab of the machine for steering the machine; and lifting means situated between the end section and said boom arm for swiveling and lifting said boom arm in the vertical plane.

20. The machine of claim 19, wherein said steering means is a steering cylinder situated between said base frame and said front fixing device.

* * * * *